United States Patent [19]

Wood

[11] Patent Number: 4,641,489

[45] Date of Patent: Feb. 10, 1987

[54] MACHINE FOR HANDLING SIGNATURES

[75] Inventor: James R. Wood, Salem, Ill.

[73] Assignee: World Color Press, Inc., Effingham, Ill.

[21] Appl. No.: 655,259

[22] Filed: Sep. 28, 1984

[51] Int. Cl.[4] ..... B65B 13/20; B65B 35/44

[52] U.S. Cl. ..... 53/529; 271/150; 271/31.1; 53/542

[58] Field of Search ..... 53/542, 529; 198/425; 271/147, 150, 31.1

[56] References Cited

U.S. PATENT DOCUMENTS

| | | | |
|---|---|---|---|
| 3,155,221 | 11/1964 | Griner | 198/425 |
| 3,178,007 | 4/1965 | Standley | 198/425 |
| 3,648,431 | 3/1972 | Hartbauer | 53/542 X |
| 3,794,154 | 2/1974 | Holt | 198/425 |
| 4,141,193 | 2/1979 | Joa | 53/542 X |
| 4,183,517 | 1/1980 | Hageman | 271/150 |
| 4,250,689 | 2/1981 | van Cutsem | 53/542 X |
| 4,296,590 | 10/1981 | Focke | 198/425 X |
| 4,531,343 | 7/1985 | Wood | 53/586 X |

FOREIGN PATENT DOCUMENTS

| | | | |
|---|---|---|---|
| 2800657 | 8/1978 | Fed. Rep. of Germany | 53/542 |
| 1476915 | 3/1966 | France | 198/425 |

*Primary Examiner*—John Sipos

*Attorney, Agent, or Firm*—Gravely, Lieder & Woodruff

[57] ABSTRACT

A machine for arranging signatures in bundles includes a receiving conveyor onto which the signatures are initially directed, and this conveyor moves the signatures in a shingled condition between deflecting surfaces which cause the signatures to simultaneously bow forwardly and rise at their leading edges so as to assume an edge-standing condition. The edge-standing signatures move onto a consolidating conveyor which advances them at a lesser velocity so that they move closer together, and here the signatures are also jogged into marginal registration. At the end of the consolidating conveyor the signatures pass onto an accumulating conveyor which normally advances the signatures at a slightly lesser velocity than the consolidating conveyor, so that the signatures pack together. However, when enough signatures to make a bundle have passed onto the accumulating conveyor, the velocity along that conveyor is increased substantially while the consolidating conveyor is stopped, and this isolates a group of edge-standing signatures from the signatures along the consolidating conveyor. This group of isolated signatures is moved by retractable push rods through a board drop assembly, where boards are placed at each end of it, and onto a compression unit where the group of signatures is tightly compressed so that a band may be placed around it.

22 Claims, 14 Drawing Figures

MACHINE FOR HANDLING SIGNATURES

BACKGROUND OF THE INVENTION

This invention relates in general to machines for handling flexible sheets, and more particularly to a machine for arranging such sheets in bundles.

U.S. patent application Ser. No. 311,348 of James R. Wood, filed Oct. 14, 1981 now U.S. Pat. No. 4,531,343, and entitled Machine and Process for Stacking and Bundling Flexible Sheet Material, shows a machine for causing signatures that are delivered from a printing press to rise out of a shingled condition and assume an edge-standing condition, all while they are conveyed along a path that leads away from the press. While the signatures are in the edge-standing condition, the machine further consolidates them and segregates them into bundles. The latter aspects of the machine are somewhat complex and not as refined as the former, and it is the latter, that is the mechanisms for consolidating and arranging the edge-standing signatures in bundles, to which this application is primarily addressed, although an improved apparatus for causing the sheets to assume an edge-standing condition is also considered.

SUMMARY OF THE INVENTION

One of the principal objects of the present invention is to provide a machine for transforming an edge-standing array of flexible sheets into compacted bundles. Another object is to provide a machine of the type stated which is ideally suited for use in conjunction with a machine for converting the sheets from a shingled orientation to an edge-standing orientation. A further object is to provide a machine of the type stated which is reliable and does not damage the sheets. An additional object is to provide a machine of the type stated which is ideally suited for handling signatures delivered by a printing press. Still another object is to provide an improved apparatus for causing signatures to rise from a shingled orientation to an edge-standing orientation. These and other objects and advantages will become apparent hereinafter.

DESCRIPTION OF THE DRAWINGS

In the accompanying drawings which form part of the specification and wherein like numerals and letters refer to like parts wherever they occur

DETAILED DESCRIPTION

Figure 1:
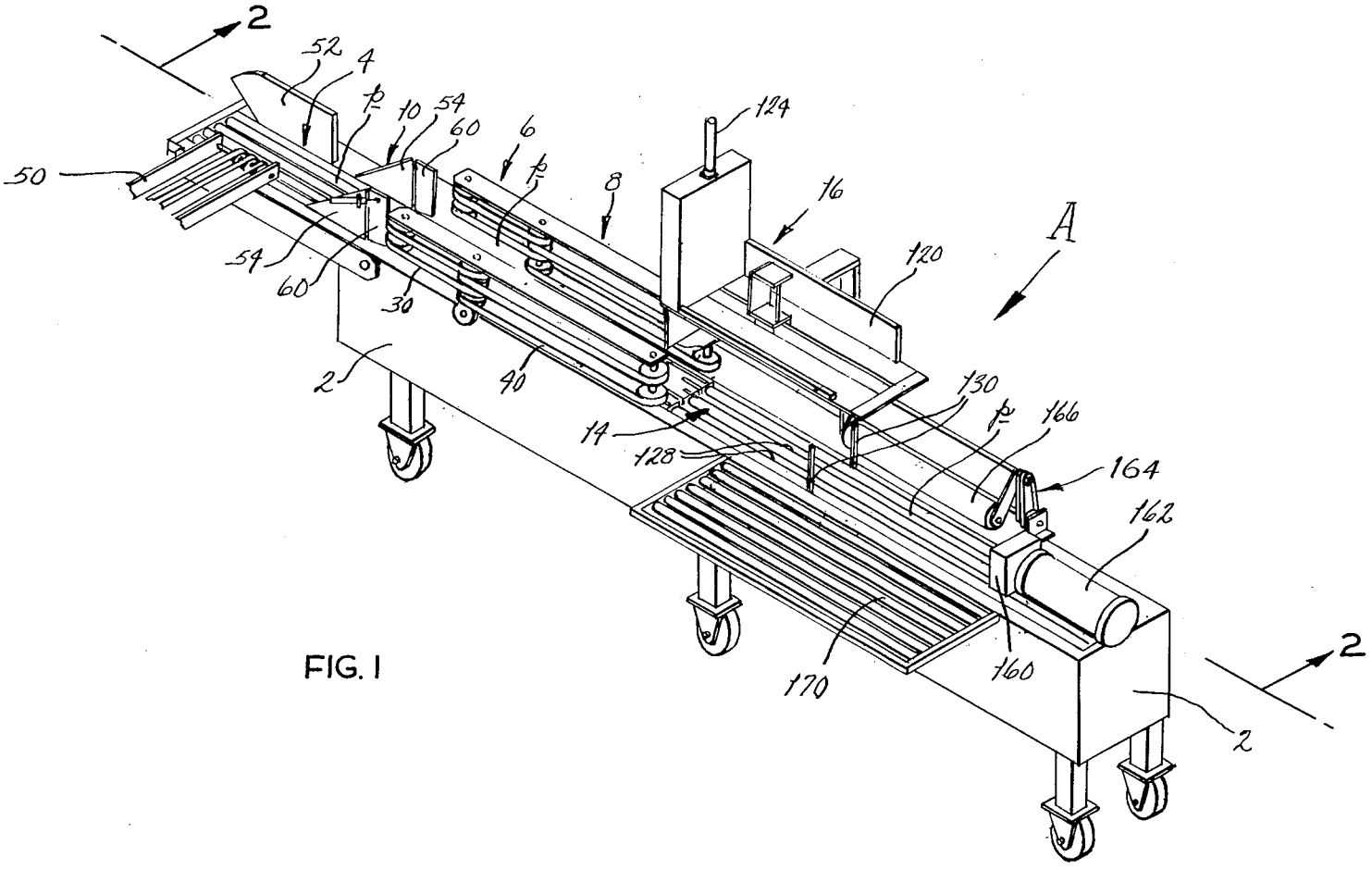
FIG. 1 is a perspective view of a machine for handling signatures constructed in accordance with and embodying the present invention.

Referring now to the drawings, a machine A receives signatures s which are delivered to it in a shingled condition from a high speed printing press. The machine A advances the signatures s along a path p (FIGS. 1 & 6), initially in a shingled condition, and as they advance causes the signatures s to rise to an edge-standing condition. As the signatures s continue to advance along the path p, the machine consolidates them, that is it causes the edge-standing signatures to move more closely together. After a significant amount of edge-standing signatures have accumulated, the machine A separates some of these signatures s from the remainder to isolate a loose bundle b which is advanced separately, having boards c placed against its ends as it does. The loose bundle b is thereafter compressed and tied to provide a compacted bundle b.

Figure 6:
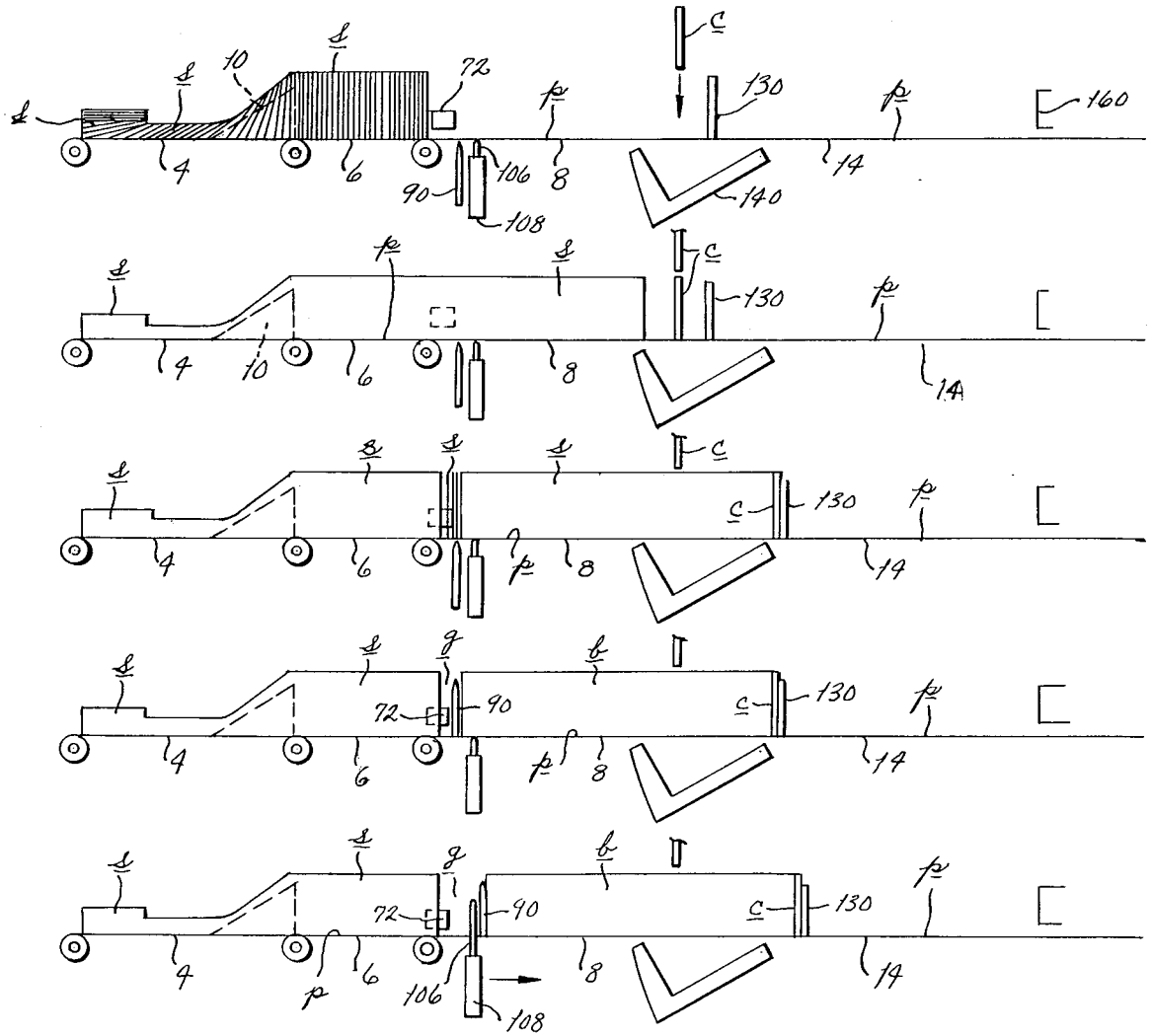
FIG. 6*a*–6*i* is a series of schematic views showing the sequence of operation for the machine as it separates edge-standing signatures into bundles and thereafter compacts such bundles.
Figure 6:
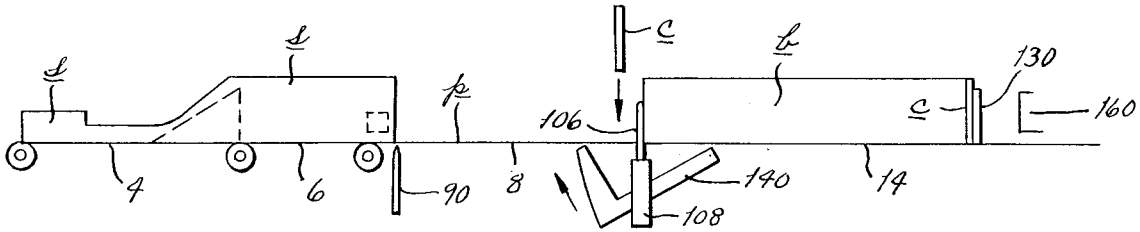
Figure 6:
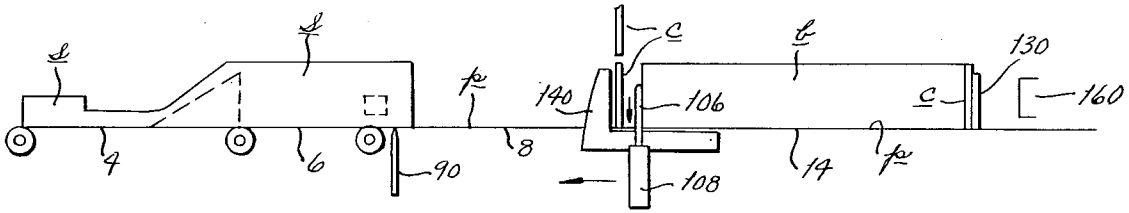
Figure 6:
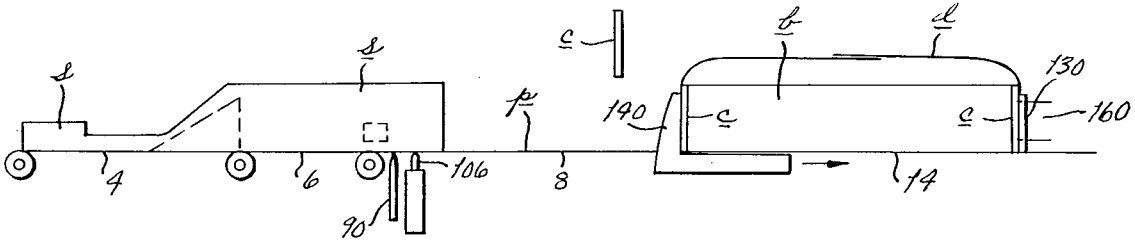
Figure 6:
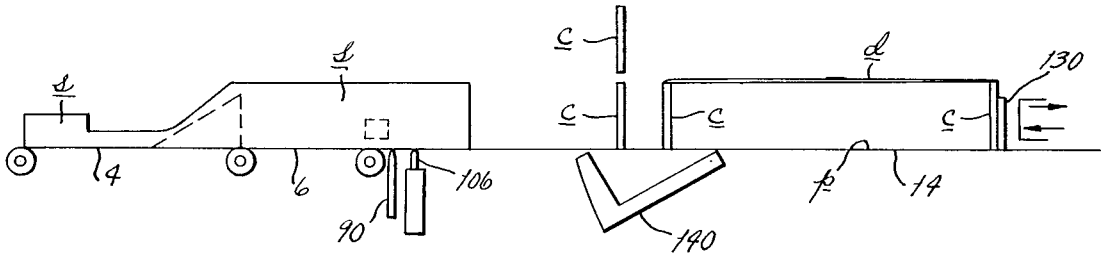

The machine A includes (FIG. 1) a frame 2 and three aligned conveyors on the frame 2, namely a receiving conveyor 4, a consolidating conveyor 6 and an accumulating conveyor 8 in that order. All lie along and indeed form the path p along which the signatures s advance. At the downstream end of the receiving conveyor 4 the frame 2 supports an orienting unit 10 which causes the signatures s, as they are advanced by the receiving conveyor 2, to rise from a shingled orientation to an edge-standing orientation. On the other hand, at the accumulating conveyor 8, the frame 2 carries a separating assembly 12 which causes the signatures s that accumulate in a edge-standing condition along the accumulating conveyor 8 to separate from the remaining signatures s so as to produce a loose bundle b (FIG. 6). The separating assembly 12 advances that bundle b at a greater velocity to a compression unit 14 which also lies in the path p, it being beyond the accumulating conveyor 8 and also supported on the frame 2. Here the separated signatures s of the loose bundle b are compressed and tied to form a compact bundle b. Finally, the frame 2 supports a board drop assembly 16 for placing one board c ahead of the signatures s as they accumulate on the accumulating conveyor 8 and another board c at the end of the signatures s which are separated so the bundle b has a rigid board c at each of its ends.

The receiving conveyor 4 includes a series of endless belts 20 (FIGS. 2 & 3) which are arranged side-by-side with their upper passes located beneath the shingled signatures s. Indeed, the belts 20 on their outwardly presented surfaces have transverse ribs which enable them to grip the signatures s at the trailing edges of those signatures s and advance the signatures s toward the consolidating conveyor 6. At both the feed and discharge ends of the conveyor 4, the belts 20 pass over pulleys which are mounted on horizontal shafts 22 and 24 that revolve in bearings on the frame 2. The shaft 24 at the discharge end is powered.

The consolidating conveyor 6 likewise has endless belts 26 located side-by-side and passing around pulleys at the ends of the conveyor 6. While the pulleys at the discharge end of the consolidating conveyor 6 are mounted on another powered shaft 28, the pulleys at the feed end are mounted on the powered shaft 24 for the receiving conveyor 4, so that the upper passes of the consolidating belts 26 form an extension of the upper passes of the receiving belts 20. Yet the pulleys for the consolidating conveyor 6 are free-wheeling on the shaft 24. The shaft 28 turns somewhat slower than the shaft 24, so that the belts 26 of the consolidating conveyor 6 move at a lesser velocity than the belts 20 of the receiving conveyor, and this enables the signatures s to pack more closely together or to consolidate after passing off of the receiving conveyor 4. Since the transition to the lesser velocity of the consolidating conveyor belts 26 is gradual, the belts 26 must be free to slip slightly with respect to the signatures s, at least at the upstream region of the conveyor 6, and hence the outwardly presented surfaces of the belts 26 are smooth.

In addition to the lower belts 26, the consolidating conveyor 6 also includes endless side belts 30 (FIGS. 2 & 3) which are located on each side of the signature path p to in effect form the sides of the consolidating conveyor 6. The side belts 30 pass around pulleys on vertical shafts 32 and 34, the latter of which is coupled to the powered shaft 28 for the lower belts 26. The arrangement is such that the inner passes of the side belts 30 and the upper passes of the lower belts 26 move in unison and at precisely the same velocity. While the powered vertical shafts 34 and the horizontal shaft 28 are at the same location along the path p, the other vertical shafts 32 are offset somewhat downstream from the common shaft 24 of the receiving and consolidating conveyors 4 and 6, and as a consequence the side belts 30 are shorter than the lower belts 26. Thus, when the signatures s move onto the consolidating conveyor 6, they are advanced only by the lower belts 26, but thereafter they come between the side belts 30 which engage their side margins and advance them along with the lower belts 26. Unlike the lower belts 26, the side belts 30 have on their outwardly presented surfaces ribs which help engage the signatures s and hold them upright.

Both the receiving and consolidating conveyors 4 and 6 are powered by a gear motor 36 (FIG. 2) which is carried by the frame 2 and is coupled to the horizontal shafts 24 and 28 and the vertical shafts 34. However, the coupling to the shafts 28 and 34 for the consolidating conveyor 6 is through a clutch-brake 37 (FIG. 3) which disengages the motor 36 from the shafts 28 and 34 to stop the belts 26 and 30 of the conveyor 6.

Figure 3:
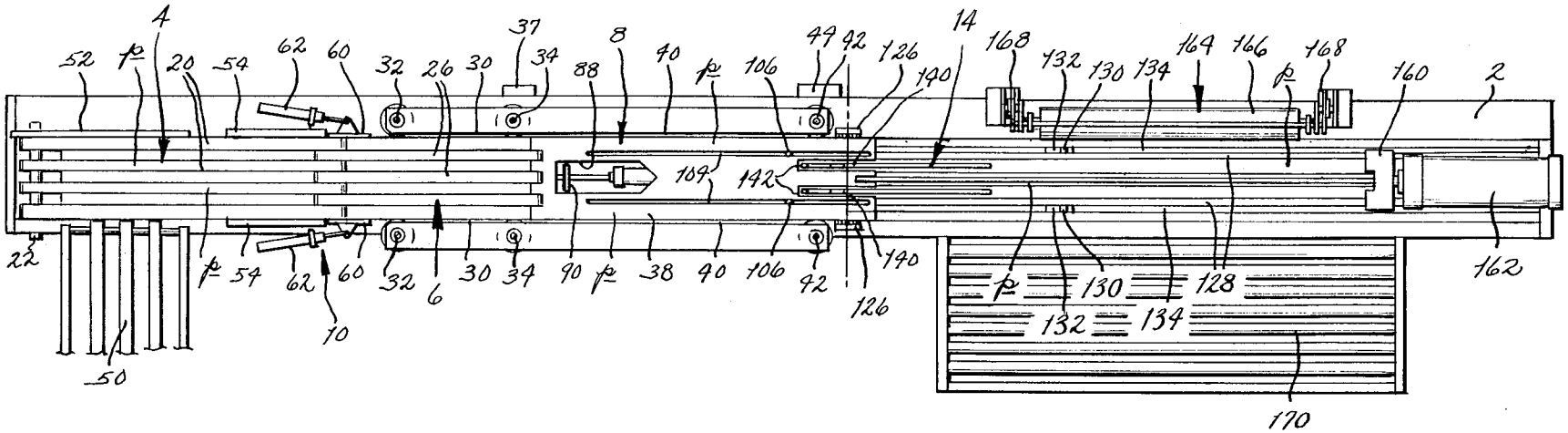
FIG. 3 is a sectional view in plan of the machine taken along line 3—3 of FIG. 2.
Figure 4:
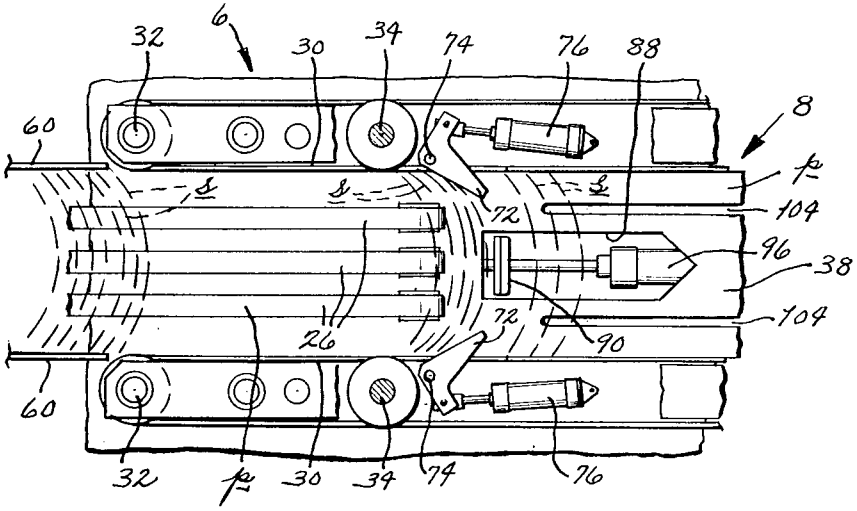
FIG. 4 is an enlarged sectional view of the machine taken along line 4—4 of FIG. 2 and showing the wings at the transition between the consolidating and accumulating conveyors extended.

The accumulating conveyor 8 includes a flat skid plate 38 (FIGS. 2 & 3) which lies along the signature path p, forming an extension of the lower belts 26 for the consolidating conveyor 6. In addition, the conveyor 8 has endless side belts 40 which are located along each side of the path p at the skid plate 38. The side belts 40 pass around pulleys that are carried by the vertical shafts 34 for the consolidating conveyor 6 as well as by powered vertical shafts 42 located downstream at the other end of the accumulating conveyor 8. The pulleys on the shaft 34 rotate freely with respect to that shaft, but not the pulleys on the shaft 42. Thus, the belts 40 derive their motion from the shafts 42, and that motion is such that the belts 40 normally move at a velocity slightly less than that of the belts 26 and 30 for the consolidating conveyor 6, their inner passes moving away from the conveyor 6. However, it is possible to increase the speed of the belts 40 significantly, and this has the effect of creating within the array of edge-standing signatures s a loose region at the transition between the consolidating conveyor 6 and the accumulating conveyor 8. To this end, the shafts 42 are also coupled to the gear motor 36 which drives the belts 40 at a lesser velocity than the belts 26 and 30 for the consolidating conveyor 6, but the connection is through an overrun clutch 44 which allows the shafts 42 to revolve at a greater velocity than that imparted to them by the gear motor 36. This greater velocity is derived from another gear motor 46 (FIG. 2) which is also carried by the frame 2 and is coupled to the shafts 42 through a clutch 48. The clutch-brake 37 and clutch 48 operate in conjunction with each other. When the clutch 48 is energized, the motor 46 turns the shafts 42 at a higher velocity than that which would be imparted to them by the motor 36, and as a consequence the signatures s on the accumulating conveyor 8 move away from the signatures s on the consolidating conveyor 6, creating the loose region in the array of signatures s (FIGS. 4 & 6*c*). At the same time the clutch-brake 37 stops the belts 26 and 30 of the consolidating conveyor 6.

Figure 5:
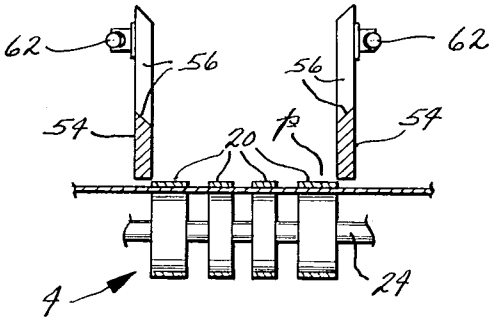
FIG. 5 is a sectional view in elevation taken along line 5—5 of FIG. 2 and showing the deflecting plates for causing the signatures to rise out of a shingled condition and assuming an edge-standing condition.

The orienting unit 10 (FIGS. 2 & 5) is located at the end of the receiving conveyor 4 and causes signatures s as they pass through it to rise from a shingled orientation to an upright or edge-standing orientation (Fig. 1*a*). In this regard, the signatures s are delivered from the press on a feed conveyor 50 (FIGS. 1 & 3) which is positioned at a right angle to the receiving conveyor 4 with its discharge end slightly higher than the adjacent feed end of the receiving conveyor 4. The feed conveyor 50 discharges the signatures s over the receiving conveyor 4 at one side of the conveyor 4 and propels them against a bump plate 52 on the opposite side of the conveyor 4. Upon striking the plate 52, each signature s drops downwardly, and as a result the signatures s accumulate in a pile at the feed end of the receiving conveyor 4 (FIG. 6*a*). Actually, this pile rests on the upper passes of the belts 20 for the receiving conveyor 4 and as the belts 20 move they withdraw the signatures s, one after the other from the bottom of the pile. However, before the belts 20 can completely withdraw the lowermost signatures s from the bottom of the pile, they come against the signature s immediately above that lowermost signature and enough friction develops between that signature s and the belts 20 to withdraw it as well. As a consequence, the signatures s leave the stack s in a tightly shingled condition, and advance toward the orienting unit 10 in that condition.

The orienting unit 10 is in effect two deflecting plates 54, there being one on each side of the conveyor 4 (FIG. 5), and these plates are spaced apart at some point along the path p a distance less than the width of the signatures s. At their upstream ends the plates 54 have beveled surfaces 56 which face generally upwardly and inwardly and furthermore are inclined upwardly in the direction of advance for the conveyor 4. As the signatures s move against the plates 54, their sides ride up onto the beveled surfaces 56, and this causes the signatures s at the orienting unit 10 to bow forwardly. The distortion tends to propagate upstream so the signatures s ahead of the unit 10 also bow slightly, but the bow gradually diminishes and does not exist at the pile where the signatures s first accumulate on the receiving conveyor 4.

As the signatures s bow forwardly at the beveled surfaces 56 on the deflecting plates 54 they are driven further into the orienting unit 10 by the underlying belts 20 of the receiving conveyor 4 which at their ribs engage the trailing edges of the signatures s, and as a consequence, the signatures s move into the space between the two plates 54, their side edges wiping against the converging surfaces of the plates 54. Thus, the forward bow remains in the signatures s at the plates 54 and is indeed amplified with the advancement into the space. The bowing coupled with the application of the propelling force at the trailing edges of the signatures s causes the leading edges of the signatures s to rise, but again the rise in the signatures s is gradual. By the time a signature s reaches the downstream end of the converging space between the two deflecting plates 54, it is standing on edge, but owing to the shingled array from which the edge-standing array is derived, the edge-standing signatures s are not consolidated, but instead are theoretically spaced at the former shingle width. Thus, the signatures s emerge from the orienting unit 10 in an edge-standing or upright, yet loosely consolidated, condition and pass onto the consolidating conveyor 6 in that condition.

The deflecting plates 54 extend downstream to about the axis of the drive shaft 24, which is common to the receiving and consolidating conveyors 4 and 6, and here the plates 54 have vertical margins to which holding plates 60 are attached with piano-type hinges. The plates 60 are urged inwardly by air cylinders 62 and indeed lie in the path p of the signatures s as a newly started array of signatures s approaches the orienting unit 10. Thus, the leading signatures of an array will not topple forwardly upon emerging from the space between the deflecting plates 54 of the orienting unit 10, but instead will come against the holding plates 60. Inasmuch as the holding plates 60, at this point in the operation of the machine A lie in the path p of the signatures s, the leading signatures s tend to consolidate against them, but when enough signatures s emerge from the orienting unit 10 they push the plates 62 outwardly against the bias of the air cylinders 62.

Eventually the holding plates 60 come against stops which align them with the inner passes of the side belts 30 for the consolidating conveyor 6. The side edges of the upstanding signatures s slide along the plates 60 as the signatures s pass from the constriction formed by the deflecting plates 54 to the side belts 30 of the consolidating conveyor 6. Thus, during normal operation of the machine A, the holding plates 60 maintain the signatures s in a bowed condition within the upstream region of the consolidating conveyor 6 (FIG. 4), and this serves to keep the signatures s upright on the lower belts 26 for that con- veyor.

The inner passes of the side belts 30 for the consolidating conveyor 6 are likewise spaced apart a distance less than the width of the signatures s, and that distance generally equals the distance between the holding plates 60 when the plates 60 are spread outwardly and aligned with the side belts 30. Hence, the signatures s remain bowed forwardly between the side belts 30 and indeed for the full length of the consolidating conveyor 6 (FIG. 3).

The consolidating conveyor 6 supports an aligning unit 66 (FIG. 2) which includes a horizontal plate 68 that extends from the space between the two deflecting plates 54 of the orienting unit 10 to the space between the side belts 30 of the consolidating conveyor 6. When unrestrained, the plate 68 is loosely suspended at an elevation higher than the holding plate 60, yet is not so high as to avoid contact with the signatures s. Mounted on the upper surface of the plate 68 is a vibrator 70 which imparts vibrations to the plate 68. As the signatures s move through the downstream region of the orienting unit 10, where the gate formed by the deflecting plates 54 is located, and thence into the initial region of the consolidating conveyor 6, they pass beneath the vibrating plate 68 which in effect rides on the upper edges of the signatures s. The vibrations tend to force the signatures s downwardly, so that the upper edges come into reasonably good registration along the consolidating conveyor 6 before the signatures s of the array are too tightly compacted.

Figure 2:
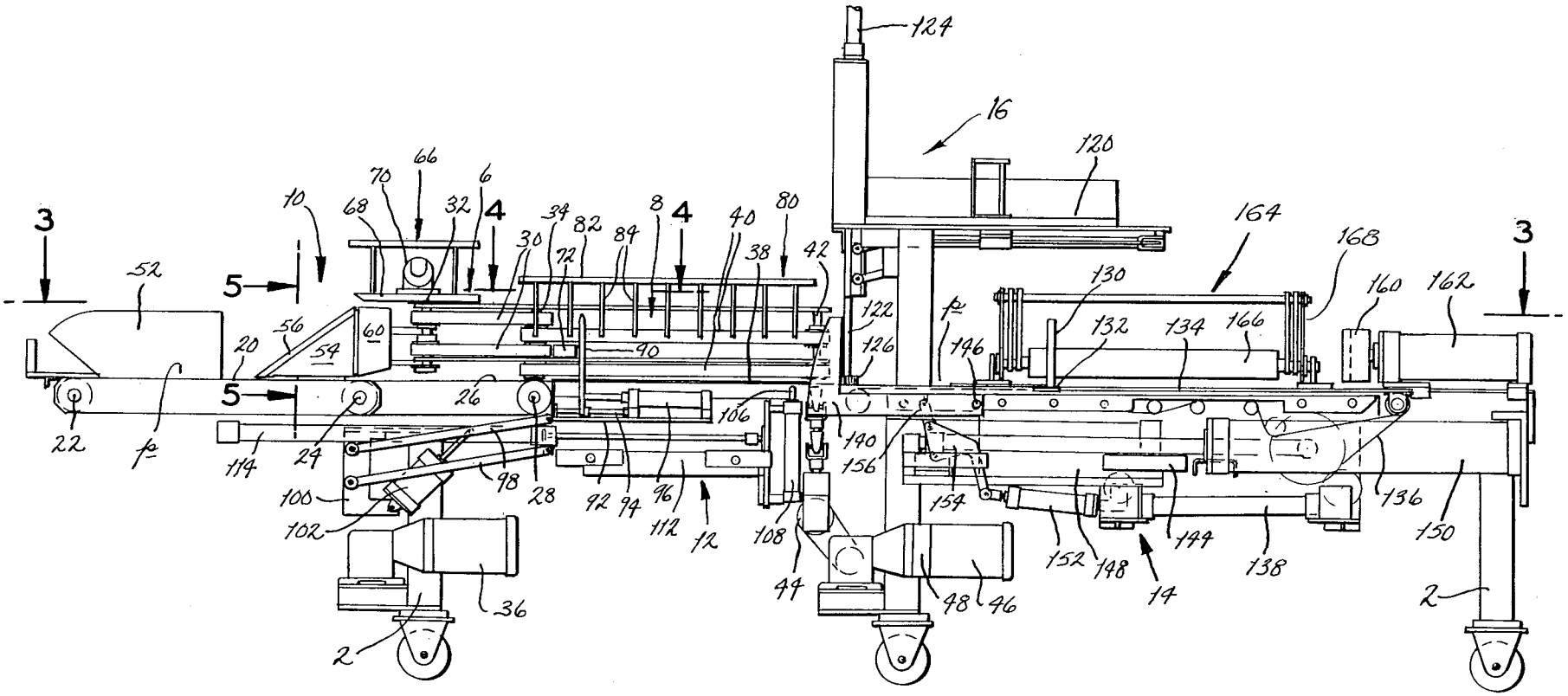
FIG. 2 is a sectional view in elevation of the machine taken along line 2—2 of FIG. 1 and showing the separator sword and compression hooks elevated and also showing the cylinder which carries the push rods somewhat out of its home position.

At its downstream end the consolidating conveyor 6 is provided with restraining wings 72 (FIG. 4) which move between retracted and extended positions. When extended, the wings 72 lie in the path p of the signatures s at the location where they transfer from the consolidating conveyor 6 to the accumulating conveyor 8. When retracted, the wings 72 lie between the side belts 40 at each side of the accumulating conveyor 8 and do not interfere with the movement of signatures s along that conveyor (FIG. 2). The wings 72 pivot about pins 74 on the accumulating conveyor 8 and are connected with air cylinders 76 which move the wings 72 between the extended and retracted positions. The wings 72 themselves have relatively flat surfaces which face the signatures s when the wings 72 are extended, lying at an angle of about 30° to 45° with respect to the direction of advance.

The signatures s as they move along the consolidating conveyor 6 are bowed forwardly, so that the midportion of each signature s leads its side edges (FIG. 4). Thus, the midportions pass into the accumulating conveyor 8 first, but in so doing they encounter only the skid plate 38 which exerts no propulsive force. The trailing side egdes, however, are in contact with the side belts 30 of consolidating conveyor 6, and those belts continue to drive the signatures s forwardly. If the wings 72 are retracted, the side edges of the signatures s merely pass to the side belts 40 of the accumulating conveyor 8 where they move forwardly at a somewhat slower velocity and hence move more closely together. Thus, a continuous array of signatures s normally exists along the consolidating and accumulating conveyors 6 and 8. However, when the wings 72 are extended, the side edges of the advancing signatures s at the end of the consolidating conveyor 6 do not pass to the side belts 40 of the accumulating conveyor 8, but instead are intercepted by the wings 72, the leading signatures being urged against the wings 72 by the continued advancement of signatures s.

The location of the pivot pins 74 is not too critical, and indeed the wings may pivot about the vertical shafts 34, in which case they are extended to the shafts 34 in the form of narrow arms which fit between adjacent pulleys on those shafts.

The wings 72 remain extended only for a short duration, and then only when the speed of the accumulating conveyor 8 is increased to advance a loose bundle b to the compacting unit 14 (FIGS. 6*d* & *e*). The two side edges of any signature s will never be precisely at the same point of advancement along the path p and by extending at the time of separation, the wings 72 prevent the signatures s at the transition between the two conveyors 6 and 8 from being propelled by side belts 30 and 40 operating at two different velocities. In other words, the wings 72 eliminate the possibility of one side edge of a signature s being driven forwardly by a fast moving belt 40 of the accumulating conveyor 8, while the other side edge remains with a slower moving belt 30 of the consolidating conveyor 6.

Mounted on the accumulating conveyor 8 is a dangle strap assembly 80 (FIG. 2 only) for preventing the signatures s at the leading end of an array of advancing signatures from toppling over primarily on the accumulating conveyor 8. The assembly 80 includes a succession of plates 82 which are hinged with respect to the accumulating conveyor 8, so that they can be folded from an operative position in which they overlie the signature path p to an outwardly directed position in which they expose and do not interfere with access to the signature path p. The first plate 82 is located immediately beyond the horizontal plate 68 of the vibrating unit 66, while the last is close to the board drop assembly 16. In addition to the plates 82, the assembly 80 includes weighted straps 84, sometimes referred to as dangle straps, which are attached to the plates 82 and depend into the path P of the signatures s when the plates 82 are in their operative positions. Here, the straps prevent the leading signatures s of an array from toppling over on the accumulating conveyor 8.

The separating assembly 12 causes a separation in the array of signatures s that passes through the accumulating conveyor 8 and onto compression unit 14, so as to isolate portion of the signatures s in the form of a loosely compacted bundle b (FIGS. *6c–f*). The separating assembly 12 for the most part lies beneath the accumulating conveyor 8 and includes the gear motor 46 and its clutch 48. When energized, these devices cause the side belts 40 of the accumulating conveyor 8 to speed up, initially for a short duration, to create looseness in the succession of signatures s at the transition between the two conveyors 6 and 8 (FIG. *6c*). The duration of the initial rapid movement lasts long enough to advance the separated signatures a short distance, perhaps as much as one inch. The wings 72 remain retracted during this initial separation.

Within the skid plate 38 of the accumulating conveyor 8 immediately downstream from the horizontal shaft 28 is an aperture 88 (FIGS. 3 & 4) that is centered between the two sets of side belts 40 for the conveyor 8. The aperture 88 is somewhat longer than it is wide and accommodates a push bar or sword 90 which may be projected through the aperture 88 from a normal storage or retracted position beneath the skid plate 38. However, the sword 90 is extended or elevated only after the initial separation has created a region of looseness in the array of signatures s, so that it will not dislodge any signatures s from the path or tear them. The sword 90 elevates at the rear or upstream end of the aperture 88 and then moves forwardly. At the same time the side belts 40 of the accumulating conveyor 8 are energized through the clutch 48. The sword 90 and belts 40 drive the signatures s on the accumulating conveyor 8 forwardly a short distance. When the sword 90 reaches the end of the aperture 88, the belts 40 stop. This creates a discernible gap g in the succession of signatures s, with all signatures downstream from the gap g constituting the loose bundle b. As the sword moves forwardly, the wings 72 extend into the path p.

To provide the foregoing vertical and horizontal motions for the sword 90, the sword 90 at its lower end is fitted to a slide 92 (FIG. 2) which moves along a horizontal slideway 94. The slide 92 is further coupled with the piston rod of an air cylinder 96 that is also mounted on the slideway 94, although in a fixed position with respect to it. When the piston rod retracts, the slide 92 and sword 90 moves out of its initial position and forwardly toward the front end of the aperture 88. The slideway 94 itself is connected to the ends of parallel links 98, the opposite ends of which are connected to a bracket 100 that is attached to the frame 2 generally beneath the orienting unit 10. This enables the slideway 94 to move upwardly and downwardly while still maintaining a horizontal orientation, and of course the sword 90 also moves upwardly and downwardly without tilting out of the vertical. This movement is effected by an air cylinder 102 which is connected between the bracket 100 and the upper of the two parallel links 98. Normally the slideway 94 is in its lower position (FIGS. *6a–c*), and the sword 90 is positioned rearwardly on it, but after the looseness is created in the succession of signatures s, the air cylinder 102 is energized to elevate the sword 90 through the aperture 88 (FIG. *6d*). Once the sword 90 reaches its upper position, the other air cylinder 96 is energized along with the side belts 40 which move the signatures s on the accumulating conveyor 8 forwardly. The cylinder 96 moves the sword 90 forwardly a short distance to the front end of the aperture 88 (FIG. *6e*), causing the sword 90 to push signatures s at the trailing end of the isolated group forwardly and thereby create the gap g.

The skid plate 38 of the accumulating conveyor 8 also has two slots 104 (FIG. 3) which extend substantially the entire length of the conveyo 8 to accommodate push rods 106 (FIG. 2) which serve along with the side belts 40 to move the isolated loose bundle b of signatures s off of the accumulating conveyor 8 and into the compression unit 14, so that more signatures s from the consolidating conveyor may accumulate on the accumulating conveyor 8. Each push rod 106 extends from an air cylinder 108 and is in fact the piston rod of that cylinder 106. The two cylinders 108 in turn are mounted on a bundle transfer sled 110 that follows a way 112 which is attached to the frame 2 generally beneath the accumulating conveyor 8. Irrespective of where the sled 110 is along its way 112, the push rod 106 of the cylinders 108 align with the slots 104. The push rods 106 of course extend and retract from the cylinders 108. Whe extended they project through the slots 104 and into the signature path p, so that they, like the sword 90, may be behind a segregated loose bundle b of signatures s. When retracted, the push rods 106 lie entirely below the skid plate 38.

The sled 110 is propelled by two air cylinders 114 that are mounted on the frame 2 beneath receiving and consolidating conveyors 4 and 6, the cylinders 114 having their piston rods connected to the sled 110. Since the push rods 106 must move essentially the full length of the accumulating conveyor 8 and beyond, the way 112 and the air cylinders 114 are quite long.

Initially the sled 110 is in its home position which means the air cylinders 114 are fully retracted (FIGS. *6a–e*). Likewise the push rods 106 are retracted (FIGS. *6a–d*). Thus, the rods 106 are initially retracted at the downstream end of the accumulating conveyor 8 (not as illustrated in FIG. 2). After the sword 90 and side belts 40 move those signatures s that are in the accumulating conveyor 8 a short distance forwardly to create the gap g and separate a loose bundle b, the cylinders 108 are energized to extend the push rods 106 (FIG. *6e*). They rise through the slots 104 and as a consequence are located opposite the trailing signatures s in the loose bundle b. At this time the belts 26 and 30 of the consolidating conveyor 6 again start moving to prevent the upright signatures s from backing up in the gate formed by the deflecting plates 54 of the orienting unit 10, but the wings 72 remain extended to prevent the signatures s at the downstream end of the consolidating conveyor 6 from passing into engagement with the side belts 40 of the accumulating conveyor 8. An instant later the cylinders 96 and 102 are energized to retract the sword 90 and move it rearwardly to its home position. At the same time, the cylinders 114 are energized to drive the push rods 106 against the end of the loose bundle b, while the side belts 40 are driven through the gear motor 46 which moves them at the increased velocity. The rods 106 and belts 40 cooperate to move the bundle b all the way to the end of the accumulating conveyor 8, beyond which the rods 106 continue to propel the bundle b and in so doing push it fully onto the compression unit 14 (FIG. 6*f*). The wings 72 remain extended and hold the signatures s at the end of the consolidating conveyor 6 away from the fast moving belts 40 of the accumulating conveyor 8. However, once the belts 40 and push rods 106 have delivered the bundle b to the compression unit 14, the clutch 48 for the gear motor 46 is de-energized, in which case the belts 40 for the accumulating conveyor 8 again derive their power from the other gear motor 36 which, operating through the overrun clutch 44, moves the belts 40 at a lesser velocity than the belts 26 and 30 of the consolidating conveyor 6. Simultaneously, the wings 72 retract and allow the signatures s at the end of the consolidating conveyor 6 to move into engagement with the slow moving belts 40 of the accumulating conveyor 8.

The board drop assembly 16 (FIGS. 1 & 2) is designed to place a board c in an upright position at the end of the accumulating conveyor 8, so that the leading signatures s in an array of signatures s will come against that board as the signatures s advance beyond the accumulating conveyor 8, the board c will advance along with the signatures s. The board drop assembly 16 is also designed to deposit a board c behind the trailing signature s in a loose bundle b that has been separated on the accumulating conveyor 8.

To this end the assembly 16 includes (FIG. 2) a rack 120 for holding a succession of boards c, each being facewise against the next, and a guideway 122 that leads downwardly from the rack 120, it being directed toward the portion of the skid plate 38 that is located immediately beyond the discharge ends of the side belts 40. The boards c do not drop freely through the guideway 122, but instead are retained in it by friction unless driven downwardly by a propelling force. Indeed, the guideway 122 is configured to hold one board c in it above the succession of signatures s which move off of the accumulating conveyor 8 and onto the compacting unit 10. The propelling force which dislodges boards c from the guideway 122 is derived from an air cylinder 124 located at the end of the rack 120. When the cylinder 124 is energized, a pusher on it comes against the endmost board c in the rack 120 and drives that board c downwardly into the guideway 122. This board c in turn forces the board c that is already in the guideway 122 downwardly, allowing it to fall onto the skid plate 38. Directly beneath the guideways 122 on each side of the path p along which the signatures s move are friction devices 126 (FIGS. 2 & 3) which engage each board c after it is dislodged from the guideway 122, and these devices maintain each board c upright in the signature path p as the succession of signatures s on the accumulating conveyor 8 approaches it (FIGS. 6*a* & *b*). The friction devices 126 need be nothing more than brush bristles located at the sides of the path p to contact the side edges of the boards c.

The signature path p continues onto the compression unit 14 in the form of skid bars 128 (FIG. 3) onto which the side belts 40, operating at increased velocity, and the push rods 106 drive the loose bundle b. The bars 128, which form part of the compression unit 14, align with the skid plate 38 of the accumulating conveyor 8. Actually, the bars are long rollers which revolve about axes that are parallel to the path p.

The compression unit 14 also includes a pair of follower bars 130 (FIG. 2) which project upwardly from a slide 132 into the path p taken by the signatures s as they pass onto skid bars 12 of the compression unit 14. The slide 132 moves along a slideway 134 on the frame 2 and is connected by means of a chain and sprocket coupling 136 to a cable cylinder 138 that is below the slideway 134. The cable cylinder 138, acting through the chain and sprocket coupling 136, urges the follower bars 130 toward the accumulating conveyor 8, and indeed, when there are no signatures s on the compacting unit 14, the bars 132 are located only slightly downstream from the friction devices 126 of the board drop assembly 16 (FIGS. 6*a* & *b*). Thus, as signatures s accumulate on the accumulating conveyor 8, they will eventually completely fill that conveyor and move against the board c previously placed in front of them by the board drop assembly 16. The signatures s thereafter dislodge that board c and move it against the follower bars 130 which yield and yet continue to direct enough force against the board c to keep the board c upright and the signatures s at the leading end of the array upright and compacted (FIG. 6*c*). The force exerted by the bars 130, which is typically 50 lbs., is derived from the cable cylinder 138. This force not only creates a compaction of the signatures s that are behind it in the compression unit 14, but further causes a progressive compaction along the accumulating conveyor 8, with the signatures s at the downstream end of the conveyor 8 being more tightly compacted than the signatures s at the upstream end.

In addition, the compression unit 14 includes compression hooks 140 which normally lie beneath the downstream end of the accumulating conveyor 8 (FIG. 2—shown elevated). Indeed, the skid plate 38 immediately ahead of the board drop assembly 16 contains slots 142 (FIG. 3) for accommodating the compression hooks 140, and these slots extend forwardly into the spaces between the skid bars 128 of the compression unit 14. The hooks 140 project upwardly and also extend generally horizontally in the direction of the path p, and at the end of their horizontal segments are connected to a sled 144 at a pivot pin 146 (FIG. 2). The sled 144 moves along a way 148 that extends beneath, yet is parallel to the skid bars 128, and when it moves, it of course brings the compression hooks 140 from their home position (FIG. 6*g*) at the end of the accumulating conveyor 8 to a position downstream and beyond the board drop assembly 16 (FIG. 6*h*). This movement, which is derived from a relatively large air cylinder 150 that is coupled between the frame 2 and the sled 144, is initiated after the pusher rods 106 move a loose bundle b past the board drop assembly 16 and also after the board drop assembly 16 places a board c behind the bundle b and the extended rods 106. As the hooks 142 move forwardly, the push rods 106 retract and the cylinder 114 moves the bundle transfer sled 110 rearwardly. The hooks 140 collect the board c and move it against the trailing signature of the bundle b before that signature topples rearwardly.

In addition to the hooks 140, the sled 144 carries a double acting air cylinder 152 (FIG. 2) and a bell crank 154 to which the cylinder is connected. The bell crank 154 is in turn connected to the compression hooks 140 through a short link 156. The arrangement is such that the cylinder 152 when extended lowers the compression hooks 140 below the skid plate 38 (FIGS. 6*a–f*)-- and when retracted elevates the hooks 140 through the slots 142 so that they are positioned behind a board c at the end of the loose bundle b at the compression unit 14 (FIGS. 6*g* & *h*).

The compression hooks 140 are normally below the skid plate 38 (FIGS. 6*a–f*), but the cylinder 152 is energized to elevate them after the push rods 106 of the separating assembly 12 reach their endmost position beyond the board drop assembly 16 (FIG. 6*g*). The hooks 140 remain elevated while the air cylinder 150 is energized to move the sled 144 and the hooks 140 forwardly along the skid bars 128 of the compression unit 14 (FIG. 6*h*). Once the bundle b is compacted and tied, the air cylinder 150 extends and so does the cylinder 152. The former moves the sled 144 back to its home position, while the latter retracts the hooks 140, causing them to drop below the level of the skid bars 128 and skid plate 38 (FIG. 6*i*).

The bundle b is compressed between the hooks 140 at one end and a stop 160 (FIGS. 2 & 3) at the other, the latter being at the end of the signature path p. Actually the stop 160 is mounted on an air cylinder 162 which in turn is secured to the frame 2. Moreover, the stop 160 is bifurcated so that a banding strap d (FIGS. 6*g* & *h*) may be passed through it. In this connection, when the bundle b is compressed, the hooks 140 bear against the board at the trailing end of the bundle b, while the board c at the leading end abuts against the stop 160 (FIG. 6*h*). At that time a banding strap d, that is in place below the bundle and with its end projected through the slot in the bifurcated stop 160, is gathered together over the bundle b, so that the strap d extends the full length of the top and bottom of the bundle b as well as across the outwardly presented faces of the boards c. The strap d is thereupon secured on top of the bundle b.

Once the banding strap d is in place, the hooks 140 withdraw and retract, and the cylinder 162 is energized to extend the stop 160 a short distance (FIG. 6*i*). The cylinder 162 immediately retracts to withdraw the stop 160 from the leading board and the strap d which extends across that board. This enables the bundle b to be moved out of the path p without snagging the strap d on the stop 160.

The movement of the completed bundle from the path p is effected by a pusher unit 164 (FIGS. 1–3) which is located along the back side of the path p, that is the side opposite the one at which the operator who attends to the machine A stands. The pusher unit 164 includes a roller 166 and a linkage arrangement 168 which moves the roller 164 from a home position to the back side of the path p out over the skid bars 128 that are along the path p. In so doing the roller 16 displaces the bundle b, causing it to move laterally off of the skid bars 128 and onto a set of supporting rollers 170 at the front side of the path p. This clears the end of the skid bars 128 so that another loose bundle b may be compressed in the compacting unit 14. The tied bundle b rests on the supporting rollers 170 until the operator finds a time that is convenient to remove it.

The machine A also includes a control unit for operating the motors 36, 46, the clutch-brake 37, the clutch 48, and the air cylinders 76, 96, 102, 108, 114, 124, 150, 152, and 162 in the sequence described.

OPERATION

When the machine A is first placed in operation, signatures s move along the feed conveyor 50 in a low shingled condition with their folds being located along one side of the conveyor 50, so that they are parallel to the direction of advance. The feed conveyor 50, at its discharge end projects the signatures s one after the other over the receiving conveyor 4 and against the bump plate 52 which they strike, dropping downwardly upon so doing. The signatures s accumulate in a slight pile at the upstream end of the receiving conveyor 4 (FIG. 6*a*), where the signatures s are jogged along the ends remote from, but parallel to, the bump plate 52, so as to bring the ends of the signatures s in the pile into registration. The height of the pile is monitored by a sensing device which controls the speed of the gear motor 46. The belts 20 of the receiving conveyor 4, as they pass beneath the pile of signatures s, withdraw signatures s one at a time from the bottom of the pile. Each signature s as it is withdrawn slides beneath the signature s above it, but before it is fully extracted the belts 20 come against the overlying signature s and move it as well. Thus, the signatures s leave the pile from beneath in a shingled condition, with the shingle being a lot tighter than the relatively loose shingle on the feed conveyor 50 (FIG. 6*a*). Furthermore, not only does the direction of advance change at the transfer from the feed conveyor 50 to the receiving conveyor 4, but the orientation of the signatures s likewise changes, for on the receiving conveyor 4 they advance preferably with their folded edges trailing and being presented downwardly.

The belts 20 of the receiving conveyor 4 move the shingled signatures s to the deflecting plates 54 where the sides of the signatures s ride up onto the beveled surfaces 56 of those plates and then move into the slightly convergent space between the plates 54. This causes the signatures s to bow forwardly and to rise at their leading edges (FIG. 6*a*). Indeed, the signatures s continue to rise as the belts 26 move them through the space between the deflecting plates 54, so that by the time they emerge from those plates they are standing on edge. Moreover, the bowing and rise tend to propogate with diminishing intensity upstream, with each signature s affecting the inclination and contour of the signature s preceding it.

The holding plates 60 at the downstream ends of the deflecting plates 54 keep the leading signatures s from falling out of the space between the deflecting plates 54, and indeed the leading signatures s push the plates 60 open against the bias exerted by the air cylinders 62. Eventually, the holding plates 60 move to a fully open position in which they are approximately parallel and aligned with the inside passes of the side belts 30 for the consolidating conveyor 6. When so disposed, the plates 60 are spaced apart a distance less than the width of the signatures s, and this maintains the edge-standing signatures s in a forwardly bowed configuration.

Upon emerging from the space between the deflecting plates 54 and entering the space between the holding plates 60, the signatures s move onto the lower belts 26 of the consolidating conveyor 6 which, traveling at a velocity less than the belts 20 of the receiving conveyor 4, cause the signatures s to consolidate. In other words, the edge-standing signatures s, having been formerly shingled, occupy more space than their actual folded thickness, and at the consolidating conveyor 6 this space is reduced. In this same region, the vibrating horizontal plate 68 which rides on the upper surface of the array of signatures s urges any high signatures downwardly so that the folded upper margins of the signatures s are generally in registration. The growing array of signatures s continues into the space between the side belts 30 of the consolidating conveyor 6 (FIG. 6*a*) and then without interruption into the space between the side belts 40 of the accumulating conveyor 8 (FIG. 6*b*). Since the belts 40 of the accumulating conveyor 8 move at a velocity less than the belts 26 and 30 of the consolidating conveyor 6, the signatures s further consolidate on the accumulating conveyor 8. Indeed, the space between signatures s is eliminated. The spacing between the side belts 30, and the side belts 40 as well, is less than the width of the signatures s, so the signatures s remain bowed throughout the length of the consolidating and accumulating conveyor 6 and 8 (FIG. 4). This bow in the signatures s together with the weighted dangle straps 84 keeps the leading signatures s upright.

As the signatures s move along the accumulating conveyor 8, they approach a board c held in the friction devices 126 of the board drop assembly 16 (FIG. 6*b*). Eventually, the leading signature s comes against this board c and the everexpanding array of signatures s pushes the board c forwardly onto the skid bars 128 of the compacting unit 14 (FIG. 6*c*). Here the follower bars 130 bear against the board c and keep it from toppling forwardly. The bars 130, being coupled with the cable cylinder 138, maintain a light force on the board c and leading signatures s, yet yield as the array of signatures s expands into the compression unit 14. This force compresses the signatures s together along the compression unit 10 and further induces a progressive compression along the accumulating conveyor 8.

When enough signatures s have passed onto the accumulating conveyor 8 to produce a bundle b of the desired size, the control unit produces a signal which initiates the separation of those signatures on the accumulating conveyor 8 from the preceding signatures s on the consolidating conveyor 6. Actually, a gap g is formed in the array of signatures at the transition between the consolidating and accumulating conveyors 6 and 8 (FIGS. 6*d* & *e*), and all signatures ahead of the gap g are further processed as a bundle b. The signal may be based from a count taken automatically along the feed conveyor 50.

The signal that signifies the commencement of the separation actuates the clutch-brake 37 that couples the belts 26 and 30 of the consolidating conveyor 4 with the gear motor 36, and as a result those belts stop. At the same instant, the other clutch 48 engages to couple the gear motor 46 with belts 40 of the accumulating conveyor 8, but the clutch 48 is engaged for a very short duration—only long enough to move the signatures s on the accumulating conveyor 8 ahead no more than about one inch (FIG. 6*c*). This loosens the signatures s at the transition between the consolidating and accumulating conveyors 6 and 8.

Next the air cylinder 102 is energized and it elevates the sword 90 into the loosely spaced signatures s at the upstream end of the accumulating conveyor 8 (FIG. 6*d*). Once the sword 90 is elevated, the air cylinder 96 is energized, and it drives the sword 90 forwardly. At the same time, the clutch 48 energizes the belts 40 of the accumulating conveyor 8, causing those belts to move at their higher velocity. The belts 40 move the signatures s on the conveyor 8 as a whole forwardly, while the sword 90 pushes the signatures s immediately ahead of it forwardly to thereby create a distinct gap g in the array of signatures, if one did not already exist (FIG. 6*e*). At the same time the air cylinders 76 for the wings 72 are energized and they move the wings 72 to their extended position wherein they lie in the signature path p, facing the signatures s at the end of the consolidating conveyor 6 (FIG. 4). Indeed, the extended wings 72 prevent the side edges of those signatures s which were not gathered by the sword 90 from coming against the side belts 40 of the accumulating conveyor 8.

The clutch-brake 37 for the consolidating conveyor 6 deactivates when the wings 72 extend, and this of course again puts the belts 26 and 30 of that conveyor in motion, so that the signatures s do not back up in the space between the deflecting plates 54. Also the air cylinders 108 of which the push rods 106 are a part are energized to project the rods 106 through the upstream ends of the slots 104 in the skid plate 38 and into the gap g cleared by the sword 90 (FIG. 6*e*). This places the push rods 106 behind the bundle b.

Now with the push rods 106 extended, the clutch 48 for the accumulating conveyor 8 is re-engaged and the air cylinder 114 is energized. As a result the side belts 40 of the accumulating conveyor 8 move at their higher speed, while the push rods 106 move forwardly through the slots 104 and along the path p. The rods 106 and belts 40 together move the separated bundle b out of the accumulating conveyor 8 and onto the roller-type skid bars 128 of the compression unit 14 (FIG. 6*f*), and once the trailing signature s clears the end of the accumulating conveyor 8, the push rods 106 continue to advance the bundle b under the force exerted by the push rods 106 until the bundle b is somewhat beyond the location at which the board drop assembly 16 deposits the board c along the path p.

Of course as the bundle b moves onto the skid bars 128 of the compression unit 14, the follower bars 130 yield, yet remain against the board c at the leading end of the bundle b to prevent both the board c and the leading signatures s from toppling forwardly. While the bundle b advances, the wings 72 remain extended to prevent signatures s at the end of the consolidating conveyor 4 from being caught up by the side belts 40 of the accumulating conveyor 8. Also the cylinder 96 pushes the sword 90 rearwardly, thereby driving any signatures s that may bow excessively from the end of the consolidating conveyor 6 back toward that conveyor.

After the bundle b is moved fully into the compression unit 14, the clutch 48 is disengaged so that the side belts 40 of the accumulating conveyor 8 revert back to their normal speed which is slightly less than the speed of the belts 26 and 30 for the consolidating conveyor 6. Also, the air cylinder 96 retracts the sword 90, while the air cylinders 76 retract the wings 72, thereby releasing the signatures s at the end of the consolidating conveyor 6, so that their side edges can move into engagement with the side belts 40 of the accumulating conveyor 8.

At the same time, the cylinder 124 of the board drop assembly 16 is energized to drive a board c downwardly into the friction devices 126 along the signature path p (FIG. 6*g*). The friction devices 126 hold the board c upright behind the extended push rods 106 at the end of the bundle b. Also, the air cylinder 152 of the compression unit 14 is energized to move the compression hooks 140 upwardly, and since the sled 144 is in its home position at this time in the cycle, the hooks 140 project through the slots 142 where they are located behind the board c held by the friction devices 126 (FIG. 6*g*).

Next in the sequence, the push rods 106 retract into their cylinders 108, while at the same time the air cylinder 114 moves the bundle transfer sled 110 rearwardly, and since the rods 106 are carried on the sled 110, they withdraw from the trailing signatures s. The cylinders 108 and 114 operate simultaneously so that the push rods 106 are not loaded as they withdraw across the trailing signature s. This of course prevents damage to the trailing signature s. Yet the rods 106 retract quickly enough to clear the lower edge of the board c held at the friction devices 126. The bundle transfer sled 110, with the push rods 106 carried by it retracted, moves back to its initial position beneath the upstream end of the accumulating conveyor 8 (FIG. 6*h*). The signatures s at the trailing end of the bundle b relax slightly as the push rods 106 withdraw, but do not fall rearwardly.

When the push rods 106 are fully retracted, which occurs in the region of the board drop assembly 16, the cylinder 150 for the compression sled 144 is energized to move that sled out of its home position. The sled 144 moves the compression hooks 140 forwardly out of the slots 142 and into the spaces between the skid bars 128 of the compression unit 14 (FIG. 6*h*). As the hooks 140 advance they collect the board c and withdraw it from the friction devices 126. Indeed, the hooks 140 move the board c against the trailing signature s of the bundle b and thereafter under the force exerted by the cylinder 150 move the entire bundle b forwardly, causing the leading board c to come against the stop 160 (FIG. 6*h*). Then as the hooks 140 continue they compress the bundle b between the hooks 140 and the stop 160. The pressure builds up to a prescribed magnitude. At the same time the cylinder 124 of the board drop assembly 16 is energized to deposit another board c in the signature path p and this board c will face more signatures s that accumulate on the accumulating conveyor 8.

With the hooks 140 exerting a substantial compressive force on the bundle b, the operator grasps a banding strap d (FIG. 6*h*), the end of which is at the stop 160 while the trailing portion is beneath the bundle b. At the leading end of the bundle b the band d feeds through the stop 160 and across the board c at that end. At the trailing end it is lifted upwardly between the hooks 140 and across the trailing board c. This portion of the band d is then brought forwardly over the top of the bundle b and secured to the free end with a typical banding device.

Once the tie band d is secured, the cylinder 150 moves the compression sled 144 back to its home position, while air cylinders 152 on that sled retract the compression hooks 140 so that they again lie below the skid plate 38 (FIG. 6*i*). At the same time the cylinder 162 on which the stop 160 is mounted extends and immediately thereafter retracts (FIG. 6*i*). This moves the bundle b a slight distance away from the stop 160 and in so doing positions the tied bundle b for removal to the supporting rollers 170.

Thereafter, the pusher unit 164 is energized, and it moves the roller 166 laterally across the signature path p. Indeed, the roller 166 bears against the side of the bundle b and drives it laterally, causing it to slide across the roller-type slide bars 128, which being rollers, revolve to accommodate the movement. The bundle b moves onto the supporting rollers 170.

Of course, while the compression hooks 140 collect the board c and force it against the trailing end of the bundle b, and likewise while the bundle b is tied, more signatures s accumulate on the accumulating conveyor 8. In time, enough signatures s accumulate on the conveyor 8 to form another bundle b, at which time another separation will occur at the transition between the consolidating and accumulating conveyors 6 and 8. The foregoing cycle will thereupon repeat, producing another tied bundle b of signatures s.

This invention is intended to cover all changes and modifications of the example of the invention herein chosen for purposes of the disclosure which do not constitute departures from the spirit and scope of the invention.

What is claimed is:

1. A machine for handling a succession of flexible sheets, such as signatures, to obtain a discrete bundle of sheets from the succession, said machine comprising: first and second aligned conveyors located along a path along which the sheets are advanced, each of the conveyors being configured to support the sheets in an edge-standing condition with the sheets being bowed forwardly in the direction of advance so that the mid-portion of each sheet leads the side edges for that sheet, each of the conveyors further having moving surfaces against which the sheets are positioned such that the sheets move with the moving surfaces, the moving surfaces of the second conveyor being along the sides of that conveyor; the second conveyor being located immediately after the first conveyor such that the sheets pass from the moving surfaces of the first conveyor to the moving surfaces of the second conveyor; drive means for normally advancing the moving surfaces of the first and second conveyors in unison, with the surfaces of the first conveyor normally moving at a velocity no less than the surfaces of the second conveyor and for further momentarily increasing the speed of the surfaces for the second conveyor to a velocity greater than the velocity of the surfaces for the first conveyor so as to produce at the location where the second conveyor leads away from the first conveyor a region of looseness in the succession of sheets; a parting member located along the path at the location where the region of looseness develops and normally being retracted from the path; means for extending the parting member generally vertically into the path so that it passes between two of the sheets in the region of looseness and for thereafter moving the parting member forwardly to create a distinct gap in the succession of sheets, so as to isolate a bundle of sheets ahead of the gap; retaining elements located along the sides of the path in the region where the second conveyor leads away from the first conveyor and being movable between retracted and extended positions, the retaining elements normally being in their retracted positions where they are located to the sides of the path so as not to interfere with the bowed sheets as they pass from the first conveyor to the second conveyor, the retaining elements when in their extended positions projecting into the path at the region of looseness such as to prevent the sides of sheets that are behind the parting member from coming against and being propelled by the moving side surfaces of the second conveyor; and means for projecting the retaining elements into the path about when the parting member moves forwardly in the path so that the retaining elements prevent sheets that are behind the parting member from moving forwardly with the parting member as the parting member creates the gap.

2. A machine according to claim 1 and further including push members which extend into the gap within the path behind the isolated bundle of sheets and means for urging the extended push members along the path and away from the first conveyor so as to move the isolated bundle of sheets off of the second conveyor, the push members being retractable from the path.

3. A machine according to claim 2 wherein the retaining elements extend into the path in the region of the transition between the first and second conveyors and prevent sheets from moving onto the second conveyor while the push members urge the isolated group of sheets at increased velocity along the second conveyor.

4. A machine according to claim 1 and further comprising another conveyor preceding and aligning with the first conveyor so that the path extends along the other conveyor as well, the sheets being initially transported along the other conveyor in a shingled condition; and deflecting members along the other conveyor for urging the side edges of the sheets inwardly such that they bow forwardly and rise at their leading edges to stand on edge as they pass onto the first conveyor.

5. A machine according to claim 1 wherein the path extends beyond the second conveyor where it has a bottom surface on which the edge-standing signatures rest, but is wide enough to permit the side edges to be substantially free so that the sheets are no longer constrained in a bowed condition, and further comprising rigid followers located along the portion of the path that is beyond the second conveyor and projecting into the path, so that the leading end of the bundle of sheets will come against the followers as the sheets move beyond the second conveyor, and means for urging the followers against the leading end of the bundle while still permitting them to yield and move along the path as the bundle advances.

6. A machine according to claim 1 wherein the drive means stops the moving surfaces of the first conveyor when the velocity of the moving surfaces of the second conveyor is momentarily increased.

7. A machine according to claim 6 wherein the drive means again causes the moving surface of the first conveyor to advance when the parting member is extended into the path.

8. A machine according to claim 7 and further comprising: a parting member located along the second conveyor where the region of looseness is developed and normally being retracted from that region, and means for extending the parting member generally vertically into the space between the sides of the second conveyor after the velocity of the belts of the second conveyor is momentarily increased so that the parting member passes between sheets within the region of looseness and for thereafter moving the parting member away from the end of the first conveyor while the retaining elements are in their extended positions, so that the sheets ahead of it are gathered and advanced, while the sheets behind it are restrained by the retaining elements, whereby a gap is created in the succession of sheets.

9. A machine according to claim 1 and further comprising means for advancing the isolated bundle of sheets along the path at a velocity substantially greater than the velocity of the belts of the first conveyor after the parting member has created the gap.

10. A machine according to claim 9 and further comprising a first compression member at the end of the path, a second compression member located along the path between the first conveyor and the first compression member and normally being retracted from the path; means for moving the second compression member into an extended position wherein it projects into the path behind the isolated bundle; and force means for reducing the spacing between the compression members while the second compression member is extended into the path so as to compress the bundle of sheets to enable a band or tie to be placed around the bundle.

11. A machine according to claim 10 and further comprising board inserting means for placing a board between the first compression member and the sheets as the succession of sheets advances along the first and second conveyors and for also placing another board between the isolated group of sheets and the second compression member.

12. A machine according to claim 10 and further comprising means located between the compression members for pushing a banded bundle of sheets laterally out of the path.

13. A machine according to claim 12 including means for displacing the banded bundle of sheets from the first compression member before the means for pushing the bundle moves the bundle laterally out of the path.

14. A machine according to claim 9 and further comprising pusher members located along the second conveyor in the region where the gap is created and normally being retracted from that region, and means for projecting the pusher members normally vertically into the gap and then moving them along the second conveyor away from the first conveyor at a velocity substantially greater than the velocity of the belts for the first conveyor so as to displace an isolated bundle of sheets.

15. A machine for providing descrete bundles of sheets as the sheets advance along a path, said machine comprising a receiving conveyor along the path and having endless belts toward which the sheets are directed facing the belts, so that the receiving conveyor moves the sheets along the path initially in a shingled condition; deflecting surfaces along the sides of the path near the downstream portion of the receiving conveyor for contacting the side edges of the sheets and urging them inwardly such that the sheets are caused to simultaneously bow forwardly and rise at their leading edges to assume a bowed edge-standing condition; a consolidating conveyor located along the path immediately beyond the receiving conveyor for advancing the edge-standing sheets that emerge from the deflecting surfaces, with the velocity of advance being less than the velocity at which the sheets move along the receiving conveyor, the consolidating conveyor being configured to retain the sheets in the edge-standing and forwardly bowed condition, whereby the succession of edge-standing sheets consolidates on the consolidating conveyor; an accumulating conveyor located along the path immediately beyond the consolidating conveyor and having endless side belts along its sides for contacting the sides of the sheets and applying forwardly directed forces to the sheets so as to advance the sheets normally at a velocity less than the velocity at which the consolidating conveyor advances the sheets, the endless belts of the accumulating conveyor being spaced apart a distance less than the width of the sheets so the accumulating conveyor is likewise configured to retain the sheets in the edge-standing and forwardly bowed condition, whereby a succession of sheets will accumulate and consolidate still further on the accumulating conveyor; a compression region located along the path beyond the accumulating conveyor, the compression region being configured along the sides of the path to allow the edge-standing sheets to assume a generally flat condition; means for simultaneously stopping the advance of sheets along the consolidating conveyor and increasing the velocity of advance along the accumulating conveyor to separate the group of sheets which have reached the accumulating conveyor from the sheets on the consolidating conveyor; retaining members in the region at the transition between the consolidating and accumulating conveyors for extending into the path to prevent sheets from passing from the consolidating to the accumulating conveyor while the latter is advancing sheets at an increased velocity; follower bars located along the path in the compression region that is beyond the accumulating conveyor and being movable along the path such that the leading end of the succession of sheets confronts the follower bars which maintain the sheets in the edge-standing condition; means for enabling the follower bars to yield in the presence of advancing sheets while exerting a force on the leading sheets to cause the sheets to compress together in the compression region and to further resist the advance of the sheets by the side belts of the accumulating conveyor such that bowed sheets on the accumulating conveyor undergo a generally progressive compression, with the sheets closest to the compression region being more tightly compressed than the sheets closer to the consolidating conveyor; and compressing means located along the path in the compression region for compressing the group of sheets still further so that a retaining device may be placed around them to secure them as a bundle.

16. A machine according to claim 15 wherein the compressing means includes a stop located along the path and facing the end of the accumulating conveyor, a compression member which extends and retract from the path at the downstream end of the accumulating conveyor, and drive means for urging the compression member toward the stop to compress the group of edge-standing sheets.

17. A machine for handling sheets of flexible material, said machine comprising: a first conveyor having endless belts which have upwardly exposed passes that move along a conveying path from an upstream loading region to a downstream orienting region, the belts of the conveyor at the loading region having sheets directed toward them with the sheets oriented such that they generally face the upwardly exposed passes, so that the upwardly exposed passes move the sheets away from the loading region in a shingled condition; and deflecting members located at the orienting region, there being at least one deflecting member on each side of the conveying path, each deflecting member having a first surface which is presented toward the first surface of the other deflecting member, with the spacing between the first surfaces of the two deflecting members being at some point along the path less than the width of the sheets, each deflecting member also having a second surface which is inclined downwardly toward and merges with the first surface of that member, the second surface further being inclined with respect to the upwardly exposed passes of the belts and extending upwardly in the direction of advance; the arrangement being such that the shingled sheets ride up onto the second surfaces where they bow forwardly and simultaneously rise at their leading edges and thereafter continue into the space between the first surfaces where the bow is maintained and the leading edges continue to rise, so that the sheets upon emerging from the deflecting members are in an edge-standing condition.

18. A machine according to claim 17 and further comprising a second conveyor aligned with the first conveyor for receiving the edge-standing sheets that emerge from the deflecting members, the second conveyor causing the sheets to advance at a lesser velocity than the first conveyor, whereby the sheets consolidate on the second conveyor.

19. A machine according to claim 18 and further comprising holding members that are urged into the path beyond the deflecting members to prevent the sheets from toppling forwardly as they emerge from the space between the deflecting members, the holding members being yieldable so that the sheets force them out of the path as they move beyond the deflecting members and onto the second conveyor.

20. A machine according to claim 17 wherein the second surface on each deflecting member is at its lowest elevation substantially at the elevation of the upwardly exposed passes of the endless belts for the first conveyor.

21. A machine for converting a succession of flexible sheets into discrete bundles of sheets, said machine comprising: a first conveyor having a bottom surface on which the flexible sheets rest in an edge-standing condition and opposite side surfaces which are spaced apart a distance less than the width of the flexible sheets, such that the edge-standing sheets along their side edges contact the side surfaces and bow toward one end of the first conveyor, the first conveyor also including endless belts having conveying passes along and forming part of at least one of the surfaces for advancing the sheets in the direction toward which the sheets are bowed; a second conveyor aligned with and having an end adjacent to that end of the first conveyor toward which the flexible sheets are advanced by the endless belts, the second conveyor extending away from the first conveyor and having a bottom surface on which the flexible sheets rest in an edge-standing condition and opposite side surfaces which are spaced apart a distance less than the width of the flexible sheets, so that the edge-standing sheets along their side edges contact the side surfaces of the second conveyor and bow away from the first conveyor and toward the other end of the second conveyor, the second conveyor further including endless belts having conveying passes located along and forming part of the side surfaces of the second conveyor for advancing the sheets in the direction toward which they are bowed; drive means for moving the belts of the first and second conveyors such that the velocity of the belts of the second conveyor is normally no greater than the velocity of the belts for the first conveyor, and for further momentarily increasing the velocity of the belts of the second conveyor to a velocity greater than the velocity of the belts for the first conveyor so as to create a region of looseness in the succession of sheets generally where the sheets pass from the first conveyor to the second conveyor; retaining elements located along the sides of the conveyors where the second conveyor leads away from the first conveyor and being movable between retracted and extended positions, the retaining elements normally being in their retracted positions where they do not interfere with the movement of sheets at the side surfaces of the first conveyor and by the side surfaces of the second conveyor, the retaining elements when in their extended positions being projected into the path from the sides thereof, and being at least in part between the conveying passes of the endless belts for the second conveyor immediately beyond the first conveyor, the retaining elements further being configured such that when they are in their extended positions they hold sheets that are at the end of the first conveyor away from the endless belts that are along the side surfaces of the second conveyor; actuating means for causing the retaining elements to be projected inwardly to their extended positions after the velocity of the belts for the second conveyor is momentarily increased to create the region of looseness, so that the retaining elements restrain those sheets located at the end of the first conveyor such that their side edges do not come against the belts of the second conveyor.

22. A machine according to claim 21 wherein the restraining elements pivot about generally vertical axes which are fixed in position with respect to the side surfaces of the first conveyor, and the restraining elements when extended have inside faces which converge in the direction that the sheets advance along the path and generally conform in orientation to and confront the side portions of the sheets which approach them on the first conveyor.

* * * * *